US008608932B2

(12) United States Patent
Clauss et al.

(10) Patent No.: US 8,608,932 B2
(45) Date of Patent: Dec. 17, 2013

(54) CYANIDE-FREE SILVER ELECTROPLATING SOLUTIONS

(75) Inventors: Margit Clauss, Kriens (CH); Wan Zhang-Beglinger, Adiigenswil (CH)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 300 days.

(21) Appl. No.: 13/239,048

(22) Filed: Sep. 21, 2011

(65) Prior Publication Data

US 2012/0067735 A1 Mar. 22, 2012

Related U.S. Application Data

(60) Provisional application No. 61/385,066, filed on Sep. 21, 2010.

(51) Int. Cl.
*C25D 3/46* (2006.01)

(52) U.S. Cl.
USPC ..... 205/263

(58) Field of Classification Search
USPC ..... 205/263
See application file for complete search history.

(56) References Cited

U.S. PATENT DOCUMENTS

| | | | | |
|---|---|---|---|---|
| 3,615,737 | A * | 10/1971 | Schneble et al. | 427/98.4 |
| 4,279,708 | A | 7/1981 | Novev et al. | |
| 5,198,132 | A | 3/1993 | Salomon | |
| 5,601,696 | A | 2/1997 | Asakawa | |
| 6,251,249 | B1 | 6/2001 | Chevalier et al. | |
| 6,814,850 | B1 * | 11/2004 | Manz et al. | 205/247 |
| 6,998,036 | B2 | 2/2006 | Dietterle et al. | |
| 7,628,903 | B1 | 12/2009 | Tsuji et al. | |
| 2003/0047460 | A1 * | 3/2003 | Gonzalez et al. | 205/257 |
| 2003/0183533 | A1 | 10/2003 | Gonzalez et al. | |
| 2005/0183961 | A1 | 8/2005 | Morrissey | |
| 2007/0151863 | A1 | 7/2007 | Morrissey | |
| 2009/0321269 | A1 | 12/2009 | Tsuji et al. | |

FOREIGN PATENT DOCUMENTS

| | | | |
|---|---|---|---|
| DE | 101 24 002 | C1 | 2/2003 |
| EP | 0 150 439 | A1 | 8/1985 |
| EP | 0 246 869 | A1 | 11/1987 |
| JP | 49072139 | A | 7/1974 |
| JP | 11-302893 | | 11/1999 |
| JP | 2005-105386 | | 4/2005 |
| WO | WO 2005/083156 | A1 | 9/2005 |

OTHER PUBLICATIONS

Hungarian Search Report of corresponding Singapore Application No. 201106796-4.

* cited by examiner

*Primary Examiner* — Edna Wong
(74) *Attorney, Agent, or Firm* — John J. Piskorski

(57) ABSTRACT

A cyanide-free silver electroplating solution may be used to electroplate mirror bright silver layers at high current density ranges and at high temperatures such as in reel-to-reel electroplating. The cyanide-free silver electroplating solution is environmentally friendly.

8 Claims, No Drawings

CYANIDE-FREE SILVER ELECTROPLATING SOLUTIONS

This application claims the benefit of priority under 35 U.S.C. §119(e) to U.S. Provisional Application No. 61/385,066, filed Sep. 21, 2010, the entire contents of which application are incorporated herein by reference.

The present invention is directed to cyanide-free silver electroplating solutions. More specifically, the present invention is directed to cyanide-free silver electroplating solutions for high speed deposition of bright silver.

Silver electroplating has been conventionally used for decoration and for dinner wares. Owing to its excellent electric characteristics, silver electroplating has had a wide utility in the electronics industry, such as for switches, connectors and current tracks for photovoltaic devices.

Many conventional silver electroplating solutions are very toxic because they contain cyanide compounds. In many cases the source of the silver ions of the electroplating solution is from a water soluble silver cyanide salt. Attempts have been made to reduce or eliminate cyanide compounds from silver electroplating solutions and at the same time maintain the desired plating performance of the silver electroplating solutions as well as adhesion of the silver to the substrate and achieve a bright silver deposit. For example, silver nitrate-thiourea solutions and silver iodide-organic acid solutions have been tried but without the success demanded of the industries which readily utilize silver electroplating solutions. Also, other silver electroplating solutions have been tried, such as silver solutions containing triethanolamine added to silver thiocyanate solutions and sulfanilic acid deriviatives and potassium iodide added to inorganic and organic acid salts of silver. However, such silver electroplating solutions have not performed to the satisfaction of the plating industries.

Cyanide-free silver electroplating solutions are less toxic to both workers in the industries and are more environmentally friendly because waste water from the solutions does not contaminate the environment with cyanide. Overall process safety is improved with cyanide-free silver electroplating solutions. However, in general, such cyanide-free silver electroplating solutions have not been very stable. The solutions typically decompose during electroplating and the silver ions in the solution are often reduced prior to deposition on the substrate, thus shortening the life of the solutions. There is also room for improvement in the maximum applicable current density as well as the physical properties of the silver deposits. Such cyanide-free silver electroplating solutions have not deposited uniform silver layers and have had poor surface appearance. They generally deposit dull silver layers. Many cyanide-free silver electroplating solutions have not been found to be suitable for industrial use in high-speed plating where current densities exceed 5 A/dm$^2$.

U.S. 20050183961 discloses cyanide-free silver electroplating solutions and methods for depositing silver. The cyanide-free silver electroplating solutions include complexing agents of hydantoin and hydantoin derivatives for complexing silver ions and 2,2'-dipyridyl for providing a mirror bright silver deposit. The published patent application discloses that the addition of the 2,2'-dipyridyl to the silver electroplating solution enables electroplating at current densities of 1-30 mA/cm$^2$ at room temperature and achieves a mirror bright silver deposit. However, 2,2'-dipyridyl is a toxic compound with an unpleasant odor, especially at high plating temperatures, i.e., 50-60° C. and greater. Accordingly, electroplating solutions which include 2,2'-dipyridyl are not suitable for high speed electroplating where high temperatures are needed. High temperatures are desired to enable substantially uniform electrolyte diffusion in the plating solution which is beneficial for high speed plating enabling increasing applicable current density. Further, 2,2'-dipyridyl presents a hazard to workers using the solutions and presents a hazard to the environment when waste water from the silver electroplating solutions is disposed.

Although there is a cyanide-free silver electroplating solution which may provide mirror bright deposits, there is still a need for cyanide-free silver electroplating solutions which provide a mirror bright silver deposit and which can be electroplated at high current density ranges at high temperatures.

Solutions include one or more sources of silver ions, one or more complexing agents chosen from hydantoin, hydantoin derivatives, succinimide and succinamide derivatives, one or more organic sulfides chosen from dialkyl sulfides and dialkyl disulfides, and one or more pyridyl acrylic acids, the solutions are cyanide-free.

Methods include: a) providing a solution comprising one or more sources of silver ions, one or more complexing agents chosen from hydantoin, hydantoin derivatives, succinimide and succinimide derivatives, one or more organic sulfides chosen from dialkyl sulfides and dialkyl disulfides, and one or more pyridyl acrylic acids, the solution is cyanide-free; b) contacting a substrate with the solution; and c) electroplating silver onto the substrate.

The combination of the organic sulfides and the pyridyl acrylic acids in the cyanide-free silver electroplating solutions provide a mirror bright silver deposit which can be electroplated at high current densities, high electroplating temperatures and can be used in reel-to-reel electroplating. In addition, the cyanide-free silver electroplating solutions are environmentally friendly because they are cyanide-free and also exclude such compounds as 2,2'-dipyridyl. Accordingly, the cyanide-free silver electroplating solutions are worker friendly and safe in operation and chemical handling.

As used throughout this specification, the terms "plating" and "electroplating" are used interchangeably. The indefinite articles "a" and "an" are intended to include both the singular and the plural.

The following abbreviations have the following meanings unless the context clearly indicates otherwise: ° C.=degrees Celsius; g=grams; mL=milliliter; L=liter; A=amperes; dm=decimeter; μm=microns; and nm=nanometers. All percentages and ratios are by weight unless otherwise indicated. All ranges are inclusive and combinable in any order except where it is logical that such numerical ranges are constrained to add up to 100%.

The aqueous silver electroplating solutions include one or more sources of silver ions. The sources of silver ions include, but are not limited to, silver oxide, silver nitrate, silver sodium thiosulfate, silver gluconate; silver-amino acid complexes such as silver-cysteine complexes; silver alkyl sulfonates, such as silver methane sulfonate and silver hydantoin and silver succinimide compound complexes. Preferably, the sources of silver ions is chosen from silver oxide and one or more silver hydantoin complexes. Since the silver electroplating solution is cyanide-free, silver cyanide compounds are excluded from the solution. The sources of silver ions are included in the aqueous solutions in amounts of 5 g/L to 100 g/L or such as from 10 g/L to 50 g/L.

The pyridyl acrylic acids include, but are not limited to, 3-(2-pyridyl)acrylic acid, 3-(3-pyridyl)acrylic acid, 3-(4-pyridyl)acrylic acid, 3-(6-phenyl-pyridyl)acrylic acid, trans-3-(3-pyridyl)acrylic, trans-3-(3-pyridyl)acrylic acid and z-2-fluoro-3-(3-pyridyl)acrylic acid. Preferably the pyridyl acrylic acid is cis-3-(3-pyridyl)acrylic acid and trans-3-(3-pyridyl)acrylic acid. The pyridyl acrylic acids are included in the silver electroplating solutions in amounts of 1 g/L to 10 g/L or such as from 2 g/L to 6 g/L.

The pyridyl acrylic acids in combination with the organic sulfides provide a mirror bright silver deposit which can be electroplated at high current densities, high electroplating temperatures and can be used in reel to reel electroplating.

The organic sulfides are chosen from dialkyl sulfides and dialkyl disulfides, more typically from substituted dialkyl sulfides and substituted dialkyl disulfides. Typically the substituted dialkyl sulfides and substituted dialkyl dislfides are thiodialkanols having the following general formula:

$$HOR_1(S)_xR_2OH$$

where $R_1$ and $R_2$ are independently ($C_2$-$C_8$)alkyl, straight or branched, preferably, $R_1$ and $R_2$ are each —$CHR_3CHR_4$—, where $R_3$ and $R_4$ are independently hydrogen, methyl group or ethyl group; and x is an integer of 1 to 2. Where x is 2 the organic sulfide is a disulfide. More preferably $R_3$ and $R_4$ are hydrogen or methyl and x is 1. Most preferably $R_3$ and $R_4$ are hydrogen and x is 1. The organic sulfides are included in the silver electroplating solutions in amounts of 1 g/L to 10 g/L or such as from 2 g/L to 8 g/L.

One or more water-soluble, nitrogen containing complexing agents chosen from hydantoin, hydantoin derivatives and succinimide derivatives are included in the silver electroplating solution. Succinimide and succinimide derivatives, hydantoin and hydantoin derivatives are included in the silver electroplating solution in amounts of 60 g/l to 250 g/L, or such as 50 g/L to 100 g/L. Hydantoin derivatives include, but are not limited to, 1-methylhydantoin, 1,3-dimethylhydantoin, 5,5-dimethylhydantoin, 1-methanol-5,5-dimethylhydantoin and 5,5-diphenylhydantoin. Succinimide derivatives include, but are not limited to, 2,2-dimethyl succinimide, 2-methyl 2-ethyl succinimide, 2-methyl succinimde, 2-ethyl succinimde, 1,1,2,2-tetramethyl succinimide, 1,1,2-trimethyl succinimide and 2-butyl succinimide.

Any of a wide variety of electrolytes may be used in the silver electroplating solutions, including acids and bases. Electrolytes include, but are not limited to, alkane sulfonic acids such as methane sulfonic acid, ethane sulfonic acid and propane sulfonic acid; alkylol sulfonic acids; aryl sulfonic acids such as toluene sulfonic acid, phenyl sulfonic acid and phenol sulfonic acid; amino-containing sulfonic acids such as amido sulfonic acid; sulfamic acid; and mineral acids such as sulfuric acid, hydrochloric acid, hydrofluoric acid and nitric acid. Salts of acids and bases also may be used as the electrolyte. Conductive salts such as alkali metal salts of chloride and nitrate may be included, such as potassium chloride and potassium nitrate. Further, the electrolyte may contain a mixture of acids, a mixture of bases or a mixture of one or more acids with one or more bases. Mixtures of acids, bases and salts also may be included. Such electrolytes are generally commercially available from a variety of sources, such as Aldrich Chemical Company, Milwaukee, Wis. Typically such electrolytes are included in the silver strike solutions in amounts of 1 g/L to 100 g/L or such as from 10 g/L to 50 g/L.

The silver electroplating solutions may contain one or more buffering agents. Buffering agents include, but are not limited to, borate buffer, such as borax, phosphate buffer, citrate buffer, carbonate buffer, and sulfamate buffer. The amount of the buffer used is that amount sufficient to maintain a pH of the plating solution at 8 to 14, preferably from 9 to 12.

Optionally one or more surfactants are included in the silver solutions. A wide variety of conventional surfactants may be used. Any of anionic, cationic, amphoteric and nonionic conventional surfactants may be used as long as it does not interfere with the performance of the silver plating. Surfactants may be included in conventional amounts known by those of skill in the art for silver electroplating solutions. Examples of commercially available surfactants are AMPHOTERGE K, AMINOXID WS-35 and RALUFON EA-15-90.

Optionally, the silver electroplating solutions include one or more additional components. Such additional components include, but are not limited to, anti-tarnish agents, levelers and ductility enhancers. Such additional components are used in conventional amounts and are known to those of skill in the art.

A substrate may be electroplated with silver by spraying the silver solution onto the surface of the substrate using conventional electroplating spray apparatus or by immersing the entire substrate into the silver solution. Conventional electroplating apparatus may be used. Although electroplating may be done at temperatures ranging from room temperature to 90° C., the silver solution is preferably used at temperatures from 30° C. to 90° C., more preferably from 40° C. to 70° C. The high temperatures enable electroplating at high current densities because at such high temperatures diffusion of the electrolyte ions is increased throughout the electroplating solution. The substrate to be plated typically functions as a cathode and any suitable conventional anode for silver electroplating may be used. The anode may be a soluble electrode, such as a soluble silver electrode or insoluble anodes may be used, such as iridium oxide. The electrodes are connected to a conventional rectifier which provides the source of current. Although current density may range from 0.1 A/dm$^2$ to 50 A/dm$^2$, typically the current density is equal to or greater than 5 A/dm$^2$, more typically from 6 A/dm$^2$ to 30 A/dm$^2$, most typically from 6 A/dm$^2$ to 15 A/dm$^2$. Such high current densities shorten the electroplating time, such as in reel-to-reel electroplating. The silver is plated onto the substrate surface such that the silver layer is directly adjacent to the surface of the substrate. The silver layer plated onto the substrate ranges in thickness from 0.5 μm to 20 μm, or such as from 3 μm to 6 μm. The substrate surfaces onto which the silver is electroplated include metals such as copper, copper alloys, nickel, nickel alloys, tin and tin alloys, silver and silver alloys, gold and gold alloys and steel. Articles which are made by this method include, but are not limited to, electrical connectors and switches for electronic devices.

When the silver electroplating solution is used to electroplate onto silver, it is to typically build-up a silver strike layer where the silver strike layer functions to improve adhesion with an underlying metal such as nickel or copper, such as in the manufacture of photovoltaic devices. Such additional silver layers plated on the silver strike layer may range in thickness from 0.5 μm to 20 μm.

While the silver electroplating solution may be used to deposit mirror bright silver layers over wide temperature ranges and current densities, the silver electroplating solution is preferably used to plate silver in reel-to-reel plating methods where high current densities and high temperatures are needed. Reel-to-reel plating is an efficient and economical method which allows for select plating of metal. Various reel-to-reel apparatus are known by those of skill in the art. The method can plate strips of manufactured products or reels of raw material before they are stamped into parts. The method starts by loading the reels onto a de-reeling station. The reel may be made of metals which include, but are not limited to, copper, copper alloys, nickel or nickel alloys or tin or tin alloys. Then by using a capstan system, the product is fed through various plating processes. The reel is plated with one or more base metals which are a different metal than the metal of which it is composed. The reel is then electroplated with silver from the silver solution to form a mirror bright silver deposit on the base metal. At the end of the line, is a take-up system which re-spools the material. Multiple reels can be run with the use of an accumulator which facilitates a smooth transition between them. Such reel-to-reel plating methods demand electroplating solutions which can be operated at high temperatures and high current densities to maintain the efficiency of the accelerated electroplating method. In reel-to-reel plating the silver electroplating solution is used at temperatures of 30° C. and higher or such as from 50° C. to 90° C. Current densities may range from 6 A/dm$^2$ to 15 A/dm$^2$.

The silver electroplating solutions may be used to provide mirror bright silver deposits wherever mirror bright silver layers are desired. The combination of the organic sulfides and the pyridyl acrylic acids in the cyanide-free silver electroplating solutions provide a mirror bright silver deposit which can be electroplated at high current densities, high electroplating temperatures and can be used in reel-to-reel electroplating. In addition, the cyanide-free silver electroplating solutions are environmentally friendly because they are cyanide-free and also exclude such compounds as 2,2'-dipyridyl. Accordingly, the cyanide-free silver electroplating solutions are also worker friendly.

The following examples are included to illustrate the invention but are not intended to limit the scope of the invention.

EXAMPLE 1

An aqueous silver electroplating solution was prepared as shown in the table below.

TABLE 1

| COMPONENT | AMOUNT |
|---|---|
| Silver ions as silver 5,5-dimethyl hydantoin | 40 g/L |
| 5,5-dimethyl hydantoin | 70 g/L |
| Sulfamic acid | 35 g/L |
| Potassium hydroxide | 50 g/L |
| 3-(3-pyridyl) acrylic acid | 4 g/L |
| Potassium nitrate | 15 g/L |
| pH | 9.5 |

Two brass coupons were provided. Each coupon was placed in a separate plating cell containing the silver solution in Table 1 above. The coupons functioned as cathodes and soluble silver electrodes were used as anodes. The cathodes, silver solutions and anodes were joined in electrical communication to a conventional rectifier. The temperature of each solution was maintained at 60° C. One coupon was electroplated with silver at a current density of 2 A/dm$^2$ and the other was electroplated with silver at a current density of 12 A/dm$^2$. The solutions in both plating cells were agitated. Electroplating was done until a silver deposit of 5 μm was obtained on each coupon. The silver electroplated coupons were then rinsed with deionized water at room temperature and air dried. Each silver electroplated coupon appeared matte.

EXAMPLE 2

An aqueous silver solution was prepared as shown in the table below.

TABLE 2

| COMPONENT | AMOUNT |
|---|---|
| Silver ions as silver 5,5-dimethyl hydantoin | 40 g/L |
| 5,5-dimethyl hydantoin | 70 g/L |
| Sulfamic acid | 35 g/L |
| Potassium hydroxide | 50 g/L |
| Potassium nitrate | 15 g/L |
| 2,2-thiodiethanol | 8 g/L |
| pH | 9.5 |

A brass coupon was provided. The coupon was placed in a plating cell containing the silver solution in Table 2 above. The coupon functioned as a cathode and a soluble silver electrode was used as an anode. The cathode, silver solution and anode were joined in electrical communication to a conventional rectifier. The temperature of the solution was maintained at 60° C. The coupon was electroplated with silver at a current density of 2 A/dm$^2$. The solution in the plating cell was agitated. Electroplating was done until a silver deposit of 5 μm was obtained on the coupon. The silver electroplated coupon was then rinsed with deionized water at room temperature and air dried. The silver electroplated coupon appeared mirror bright.

EXAMPLE 3

The method disclosed in Example 2 above was repeated using the same aqueous silver electroplating solution with the same electroplating conditions except that the current density was 12 A/dm$^2$. The silver deposit obtained was matte in appearance in contrast to the mirror bright coupon of Example 2.

EXAMPLE 4

An aqueous silver solution was prepared as shown in the table below.

TABLE 4

| COMPONENT | AMOUNT |
|---|---|
| Silver ions as silver 5,5-dimethyl hydantoin | 40 g/L |
| 5,5-dimethyl hydantoin | 70 g/L |
| 2,2-thiodiethanol | 2 g/L |
| 3-(3-pyridyl) acrylic acid | 4 g/L |
| Potassium nitrate | 15 g/L |
| Potassium hydroxide | 50 g/L |
| Sulfamic acid | 35 g/L |
| pH | 9.5 |

A brass coupon was provided. The coupon was placed in a plating cell containing the silver solution in Table 4 above. The coupon functioned as a cathode and a soluble silver electrode was used as an anode. The cathode, silver solution and anode were joined in electrical communication to a conventional rectifier. The temperature of the solution was maintained at 60° C. The coupon was electroplated with silver at a current density of 12 A/dm$^2$. The solution in the plating cell was agitated. Electroplating was done until a silver deposit of 5 μm was obtained on the coupon. The silver electroplated coupon was then rinsed with deionized water at room temperature and air dried. The silver electroplated coupon appeared mirror bright.

The combination of the β-thioalkanol, 2,2-thiodiethanol, and the 3-(3-pyridyl)acrylic acid enabled a mirror bright silver deposit at the high current density of 12 A/dm$^2$. In contrast, the silver electroplating solution in Example 1 which included 3-(3-pyridyl)acrylic acid without the 2,2-thiodiethanol failed to provide a mirror bright silver deposit at both the low current density of 2 A/dm$^2$ as well as the high current density of 12 A/dm$^2$. Although Example 2 which included 2,2-thiodiethanol without the 3-(3-pyridyl)acrylic acid enabled a mirror bright silver deposit at the low current density of 2 A/dm$^2$, it failed to produce the same mirror bright deposit at the high current density of 12 A/dm$^2$ in Example 3. Accordingly, in order to achieve the desired mirror bright silver deposit at the high current density of 12 A/dm$^2$, the combination of 2,2-thiodiethanol and 3-(3-pyridyl)acrylic acid was needed.

What is claimed is:

1. A solution comprising one or more sources of silver ions, one or more complexing agents chosen from hydantoin, hydantoin derivatives, succinimide and succinimide derivatives, one or more organic sulfides chosen from dialkyl sulfides, substituted dialkyl sulfides, dialkyl disulfides and substituted dialkyl disulfides, and one or more pyridyl acrylic acids, the solution is cyanide-free.

2. The solution of claim 1, wherein the pyridyl acrylic acids are chosen from 3-(2-pyridyl)acrylic acid, cis-3-(3-pyridyl) acrylic acid, 3-(4-pyridyl)acrylic acid, 3-(6-phenyl-pyridyl) acrylic acid, trans-3-(3-pyridyl)acrylic acid and z-2-fluoro-3-(3-pyridyl)acrylic acid.

3. The solution of claim 1, wherein the hydantoin derivatives are chosen from hydantoin, 1-methylhydantoin, 1,3-dimethylhydantoin, 5,5-dimethylhydantoin, 1-methanol-5,5-dimethylhydantoin and 5,5-diphenylhydantoin.

4. The solution of claim 1, wherein the substituted dialkyl sulfide is a β-thiodialkanol.

5. A method comprising:

a) providing a solution comprising one or more sources of silver ions, one or more complexing agents chosen from hydantoin, hydantoin derivatives, succinimide and succinimide derivatives, one or more organic sulfides chosen from dialkyl sulfides, substituted dialkyl sulfides, dialkyl disulfides and substituted dialkyl disulfides, and one or more pyridyl acrylic acids, the solution is cyanide-free;

b) contacting a substrate with the solution; and c) electroplating a silver onto the substrate.

6. The method of claim 5, wherein a current density is equal to or greater than 5 A/dm$^2$.

7. The method of claim 6, wherein the current density is from 6 A/dm$^2$ to 15 A/dm$^2$.

8. The method of claim 5, wherein a temperature of the solution is 30° C. to 90° C.

* * * * *